US007240808B2

(12) United States Patent
Brugger

(10) Patent No.: US 7,240,808 B2
(45) Date of Patent: Jul. 10, 2007

(54) DOSING DISPENSER

(76) Inventor: Gerhard Brugger, Schongauerstr. 10, D-87616 Marktoberdorf (DE)

( * ) Notice: Subject to any disclaimer, the term of this patent is extended or adjusted under 35 U.S.C. 154(b) by 0 days.

(21) Appl. No.: 10/513,846

(22) PCT Filed: Jan. 11, 2003

(86) PCT No.: PCT/EP03/00197

§ 371 (c)(1),
(2), (4) Date: Jul. 1, 2005

(87) PCT Pub. No.: WO03/092904

PCT Pub. Date: Nov. 13, 2003

(65) Prior Publication Data

US 2006/0037974 A1 Feb. 23, 2006

(30) Foreign Application Priority Data

May 4, 2002 (DE) ..... 202 07 029 U

(51) Int. Cl.
*B67D 5/52* (2006.01)

(52) U.S. Cl. ..... 222/135; 222/144.5; 222/145.7

(58) Field of Classification Search ..... 222/135, 222/144.5, 145.7

See application file for complete search history.

(56) References Cited

U.S. PATENT DOCUMENTS 4,773,562 A 9/1988 Gueret
5,169,029 A * 12/1992 Behar et al. ..... 222/145.7
5,462,203 A * 10/1995 Stern ..... 222/137
5,609,299 A 3/1997 Foster et al.
5,967,372 A 10/1999 Favre

FOREIGN PATENT DOCUMENTS

| | | | |
|---|---|---|---|
| DE | 4120644 | C | 3/1993 |
| DE | 29511932 | U | 11/1996 |
| DE | 19818434 | | 4/1998 |
| DE | 20006099 | U | 7/2000 |
| EP | 610724 | A2 | 8/1994 |
| EP | 755721 | A2 | 1/1997 |
| FR | 2789371 | A | 8/2000 |
| WO | WO9727121 | A1 | 7/1997 |
| WO | WO0009270 | A1 | 2/2000 |

* cited by examiner

*Primary Examiner*—Philippe Derakshani
(74) *Attorney, Agent, or Firm*—Knobbe Martens Olson & Bear LLP

(57) ABSTRACT

According to the invention, a dosing dispenser of simple construction, for the dosing of components held in a reservoir section by at least one pump unit connected thereto and an adjuster element, which may be pivoted about a horizontal axis by a handle for operation of a pump piston of the pump unit and about a vertical axis for adjustment of the amount ratios of the components may be produced. The pump piston comprises at least one guide for a non-tipping and/or non-rotating mounting in the upper region thereof. A particularly stable operation of the pump piston may thus be guaranteed.

8 Claims, 2 Drawing Sheets

DOSING DISPENSER

BACKGROUND OF THE INVENTION

1. Field of the Invention

The invention relates to a dosage dispenser according to the preamble of claim 1.

2. Description of the Related Art

Dosage dispensers are known from EP 0 755 721 A2 and DE 198 18 434 in which the mixing ratio of two pasty or fluid components can be adjusted in a continuous manner. Such a dosage dispenser can be used advantageously as a dispenser for sun lotion in order to mix two sun lotion components with a sun lotion factor of 1 and of 25 for example, so that the sun lotion factor can be set in a continuous manner in the region of 1 to 25. Said dosage dispenser represents a substantial improvement for the consumer because the consumer can choose the sun lotion factor pending on the insulation and the acclimatization of the skin and the consumer does not have to carry several containers with different sun lotion factors around with him.

Even in the further development of the proposed solution according to WO 00/09270 (especially FIG. 3), the dosage dispenser comprises two pump units, to each of which an exchangeable cartridge is associated which each contains a type of sun lotion with highly differing sun lotion factors. The pump units or their pump plungers are actuated via an adjusting element which is in operative connection with a pump or nozzle head which is held in the housing of the dosage dispenser and is actuated by the consumer via a handle.

The known dosage dispensers have principally proven their worth in practice. However, the pump units or their pump plungers can be subjected to considerable tilting and/or twisting moments when actuated with the pressed-down adjusting element, so that they can get "jammed" in their respective pump unit.

SUMMARY OF THE INVENTION

In contrast to this, the invention is based on the object of providing a dosage dispenser which in combination with a simple constructional configuration ensures a secure guidance of the pump plunger.

DETAILED DESCRIPTION OF THE PREFERRED EMBODIMENT

Figure 1:
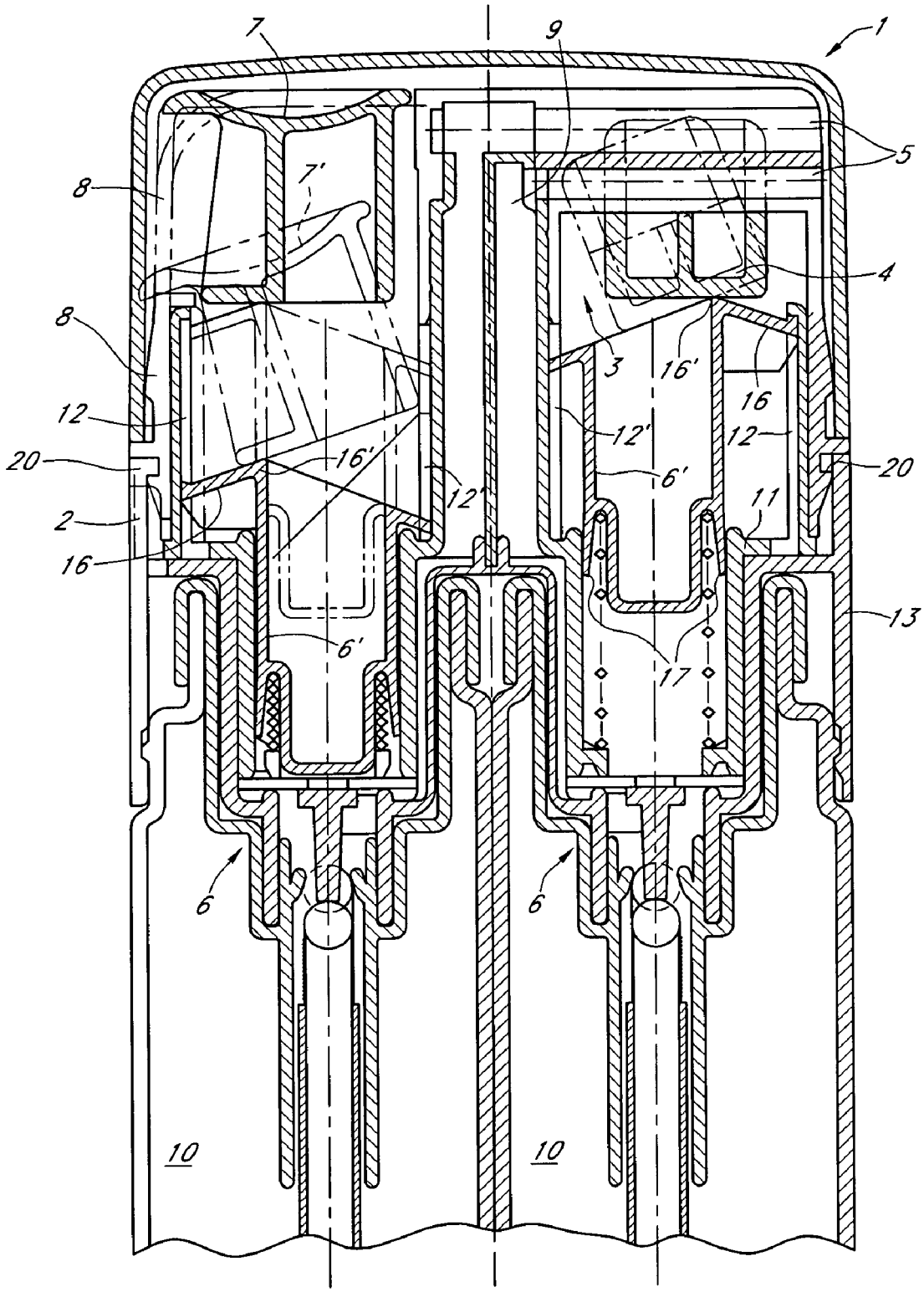
FIG. 1 shows a sectional view of the dosage dispenser in accordance with the invention with two pump units.

This object is achieved by a dosage dispenser in accordance with the features of claim 1. Preferred embodiments are the subject matter of the sub-claims.

In comparison with the dosage dispensers as described above, the solution in accordance with the invention has a substantially simpler and more stable configuration because the pump unit comprises in its upper region a guide means which is resistant to tilting and twisted, and especially comprises a collar formed thereon. This arrangement allows the guidance of the pump plunger to be executed in a substantially more stable manner than the configurations as described above and the number of movable components can be reduced. Preferably, the collar is formed integrally with the respective pump plunger. In particular, it is configured as an injection-molded part.

An especially advantageous aspect is that a guide rail is provided radially each on the inside and outside for guiding the pump plunger of the dosage dispenser, which guide rail can also be formed in an integral manner on the mixing unit. An especially exact guidance of the pump plunger is thus achieved when it is actuated. The proposed dosage dispenser can be mounted in an especially simple and stable manner and comes with a low overall height.

A preferred embodiment of the invention is explained below by reference to the enclosed drawings FIG. 1 will be used at first to describe the basic concept of the dosage dispenser 1 in accordance with the invention, according to which the adjustment of the mixture occurs by twisting an adjusting element 3 about the vertical axis relative to several pump units 6 which are actuated via the adjusting element 3. A pivoting axis 4 is arranged integrally on the adjusting element 3 and is thus adjustable jointly with the same relative to a housing 2 and the pump units 6.

The adjusting element 3 is provided in the illustrated embodiment with an annular or disk-like configuration, so that said adjusting element 3 is rotatable about a vertical axis and is further pivotable about the pivoting axis 4 which is arranged approximately transversally thereto. The adjusting element 3 rests with its lower side on the two pump units 6 (which means more precisely at a contact point 16' each in the form of a rounded tip), so that by pressing down the adjusting element 3 about the pivoting axis 4 a pumping stroke can be introduced upon the respective piston plunger 6'. This pivoting or pressing down of the adjusting element 3 about its pivoting axis 4 occurs through a handle 7 which can be actuated by hand and which is provided at the edge of a housing head 8 which is held on the housing 2 and in which a delivery or mixing nozzle 5 for the mixture is arranged.

As is shown in FIG. 1 (assembly drawing), the housing 2 carries the rotatable housing head 8 on which the mixing nozzle 5 is also arranged. The mixture set via the stroke of the pump units 6 passes through the same. The adjustment of the mixture occurs by twisting the housing head 8 relative to the housing 2, with latching points 20 being provided on the circumference of the housing head 8 for fixing the mixing unit 11. The receptacle sections 10 such as cartridges, glasses and bags for the components of the mixture can be fastened via connecting flanges on the housing 2. The components contained therein are guided via the central delivery nozzle 9 to the discharge or mixing nozzle 5 which emerges in a radial fashion from the housing head 8.

If the adjusting element 3 is pressed downwardly or deflected by pressing down the handle 7, it performs a pivoting movement about the pivoting axis 4, so that only the pump head of the pump unit 6 which is on the left side in FIG. 1 is pressed downwardly. The left pump 6 thus has a stroke or conveying volume of 100%. The pump unit 6 which is on the right side in this case and which is not pressurized because it is situated below the pivoting axis 4 has a stroke or conveying volume of 0% (relating to the total output quantity). The discharged quantity thus only contains portions of the component conveyed by the left pump unit 6 via an annular channel 21 from the left receptacle section 10.

When the adjusting element 3 is turned by 90°, an alignment of the pivoting axis 4 is obtained in which the same extends at a parallel distance to the connecting line of the two pump units 6. If based on this position the adjusting element 3 is pressed downwardly, the two pump units 6 are pushed downwardly by the same path, so that both pumps have an identical stroke or a conveying volume of 50% of the total output quantity. The mixture then contains the same parts if the two components from the receptacle sections 10. In the case of respective intermediate positions of the adjusting element 3 and its pivoting axis 4, respective intermediate conditions are obtained between the strokes or conveying volumes of pumps 6, so that they are continuously adjustable for each component between 0%:100% and 100%:0%.

Figure 2:
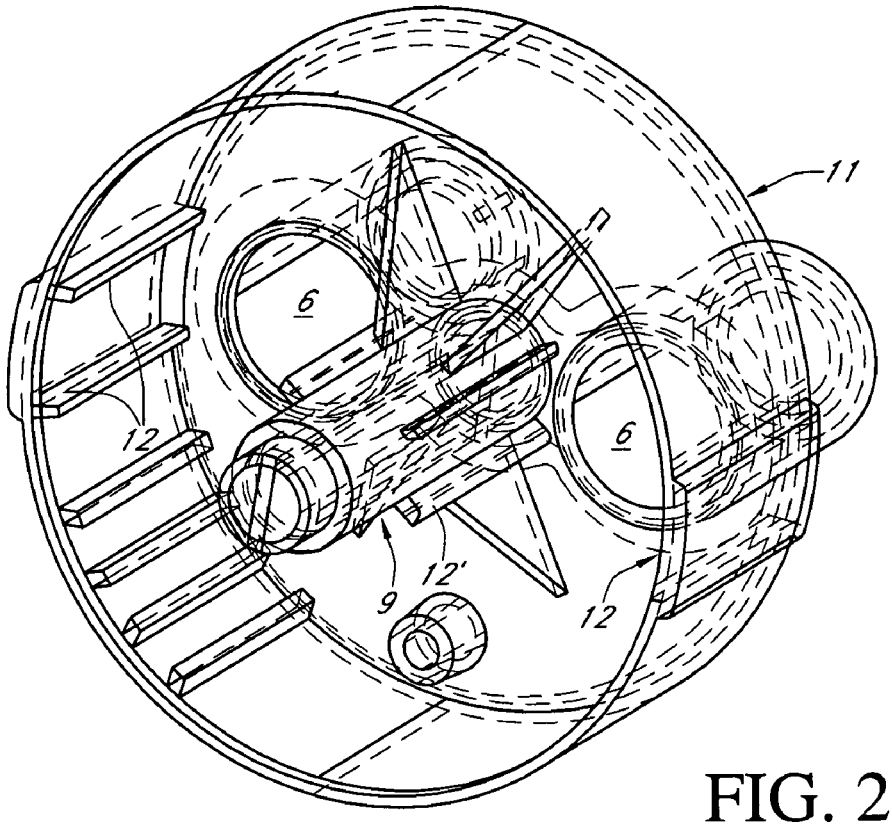
FIG. 2 shows a preferred embodiment of a mixing unit for receiving the pump units in a perspective view.
Figure 3:
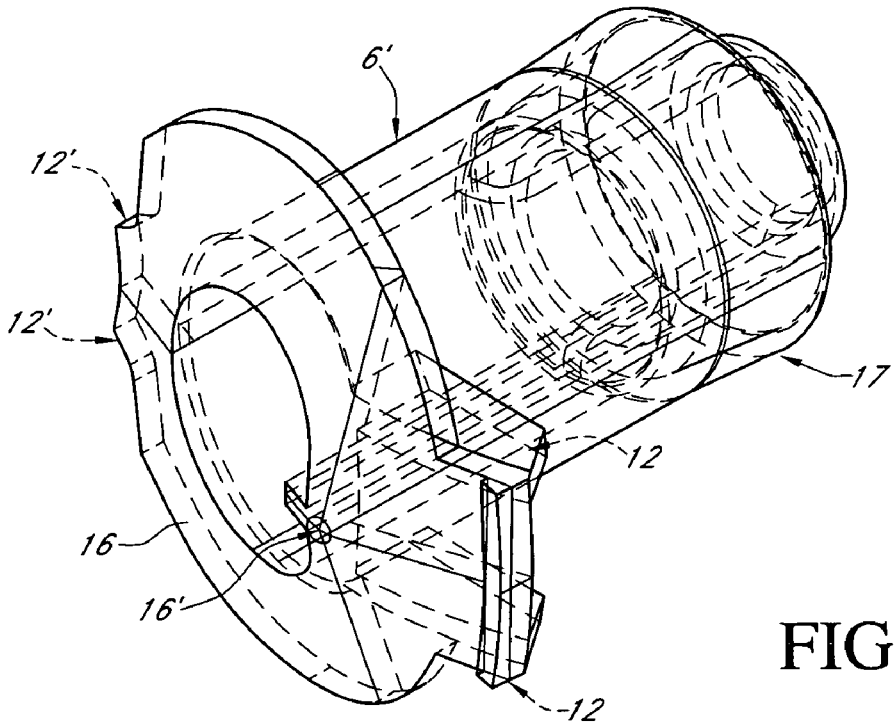
FIG. 3 shows a three-dimensional view of a pump plunger of the dosage dispenser.

Since during the actuating stroke it is possible that lateral forces may act upon the pump plunger 6', at least one guide means and preferably two guide means 12 and 12' are provided for the mounting of the same to protect it from tilting or twisting, as is shown in an enlarged view in FIGS. 2 and 3. The guide means 12 and 12' are configured in the manner of guide rails and are preferably stiffened by means of a collar 16 each on the pump plunger 6'. As is shown in FIG. 3, the two guide rails 12 and 12' are preferably configured in an integral manner on the radial inside and outside of a mixing unit 11 and the radially projecting webs of the pump plunger 6' (indicated by reference numerals 12 and 12' with the broken lines) are guided in an especially stable manner.

As is shown in particular in FIG. 2, the respective radially outer guide means 12, 12' is arranged on the circumference of the annular mixing unit 11, whereas the radially inner guide means 12' is arranged on a central delivery channel 9. The mixing unit 11 is arranged in the illustrated constructional concept as an annular hollow body with a plurality of radially extending stiffening ribs and further comprises in its center a tower-like delivery channel 9, as is also shown in FIG. 1.

FIG. 3 shows an enlarged view of the pump plunger 6' of the dosage dispenser in accordance with the invention, which especially shows the configuration of the collar 16. Said laterally projecting collar 16 engages after the insertion of the pump plunger 6' in the respective pump unit 6 (cf. cylindrical recess in FIG. 2) with the projecting webs into the two guide rails 12 and 12' on the mixing unit 11, as is indicated with the broken lines, thus leading to an especially stable guide means. Moreover, the pump plunger 6' comprises at its lower end an integrally formed seal 17, which allows considerably reducing the number of the required components for the pump unit 6. This ensures a secure guidance of the pump plunger 6', since in addition to the tilt- and twist-proof guidance on the guide rails 12, 12' the collar 16 encloses the upper end of the pump plunger 6' and reinforces the same in addition. The contact point to the adjusting element 3 is thus further formed in a simple manner as a rounded tip 16'.

As is shown in the figures, the dosage dispenser 1 can be provided with a short axial length, which thus leads to an especially compact design. The individual components, and especially the adjusting element 3, the housing head 8, the mixing unit 11 and the housing 2, are preferably produced by injection molding and are mutually joined by latching or snap-on connections (e.g. 20), which thus allows obtaining simple mounting.

In the described embodiment, the components from the receptacle sections 10 are delivered to a common central delivery channel 9. In principle the individual components could also be guided separate from each other to the delivery or mixing nozzle 5, so that thorough mixing does not occur there yet. The mixing nozzle 5 can preferably emerge in the radial direction or even centrally from the face surface of the housing head 8.

The invention claimed is:

1. A dosage dispenser for dosing components which are contained in a receptacle section, comprising two pump units connected to said section and an adjusting element which is pivotable about a vertical axis for actuating a pump plunger of each of the pump units by means of a handle about a horizontal pivoting axis and for setting the quantity ratio of the component with a housing head, the receptacle section further comprising at least two guide means adapted to guide and stabilize each pump plunger at its respective upper region for tilt-proof mounting, wherein at least one of the at least two guide means is disposed between the two pump units.

2. A dosage dispenser according to claim 1, wherein the guide means are formed integrally on a mixing unit, especially by means of injection molding.

3. A dosage dispenser according to claim 1, wherein the guide means are arranged as guide rails.

4. A dosage dispenser according to claim 1, wherein the two guide means for each of the pump plungers are arranged in a radial direction, one substantially at a center and one substantially at an outer portion of the receptacle section.

5. A dosage dispenser according to claim 1, wherein a collar is integrally formed on at least one of the pump plungers.

6. A dosage dispenser according to claim 4, wherein the collar is arranged in an annular circular manner between the two guide means.

7. A dosage dispenser according to claim 1, wherein each of the pump plungers comprises a rounded tip as a contact point to the adjusting element.

8. A dosage dispenser according to claim 1, wherein each of the pump plungers comprises in its lower region an integrally formed seal.

* * * * *